United States Patent [19]

Schweitzer

[11] 4,085,873

[45] Apr. 25, 1978

[54] KNAPSACK WITH INTEGRAL STORAGE AND CARRYING POUCH

[76] Inventor: Judith J. Schweitzer, 431 N. Armistead St., #T-5, Alexandria, Va. 22312

[21] Appl. No.: 720,526

[22] Filed: Sep. 7, 1976

[51] Int. Cl.[2] ..... A45F 3/04

[52] U.S. Cl. ..... 224/8 R; 150/28 R; 224/9

[58] Field of Search ..... 224/8 R, 8 A, 9; 150/1.7, 28 R; 190/43; 2/87, 93, 108, 69, 69.5; D2/183, 184

[56] References Cited

U.S. PATENT DOCUMENTS 2,532,778 12/1950 Mintzes ..... 150/1.7

3,085,254 4/1963 Cutler ..... 2/87 X

*Primary Examiner*—Trygve M. Blix
*Assistant Examiner*—Jerold M. Forsberg
*Attorney, Agent, or Firm*—Pollock, Vande Sande & Priddy

[57] ABSTRACT

An improved knapsack or similar receptacle of thin, flexible material includes a patch of the material attached to a wall thereof. An opening through the patch permits the receptacle to be pushed through the opening to form a carrying and storage pouch for the receptacle. A closure is provided for the opening, the closure being operable after the pouch has been formed. A carrying handle is also provided. The receptacle is specially configured for carrying a tennis racquet and balls.

13 Claims, 7 Drawing Figures

KNAPSACK WITH INTEGRAL STORAGE AND CARRYING POUCH

BACKGROUND OF THE INVENTION

The rapid growth in popularity in recent years of bicycling and hiking has resulted in the development of numerous accessories in the form of backpacks and knapsacks. While the known forms of these devices are in many cases admirably suited for their intended purposes when fully packed, the empty pack is often rather bulky and inconvenient to carry. For example, if the uses wishes to hike or bicycle to a particular place to pick up supplies, the pack must be carried along until it is needed. Or, if the pack is used to carry sports equipment such as a tennis racquet and balls, it is inconvenient to have to contend with a bulky object which must be left beside the playing area after it has been emptied. Often, the user on a bicycle must be encumbered with the empty pack on his or her back, particularly since most prior art packs are not convertible for safe attachment to a bicycle. Even the hiker has to carry the pack with its bulky assemblage of straps, flaps and so forth. Thus, a need exists for a backpack or knapsack which is compact and lightweight and which includes some provision for easily collapsing the empty pack into a configuration easy to store and carry.

OBJECTS OF THE INVENTION

An object of the invention is to provide an improved knapsack or backpack having a storage pouch into which the device may be stuffed for carrying or storage.

Another object of the invention is to provide such a device which is especially suited for carrying a tennis or similar racquet and balls.

These objects are given only by way of example. Thus other desirable objects and advantages inherently achieved by the invention may occur to those skilled in the art. Nonetheless, the scope of the invention is to be limited only by the appended claims.

SUMMARY OF THE INVENTION

The above objects and other advantages are achieved by my invention which concerns an improved type of knapsack or backpack or other carrying receptacle made of thin flexible material. A patch of this material is attached around the perimeter of the patch to a wall of the receptacle. An opening through the patch within the perimeter permits the wall of the receptacle to be pushed out through the opening to form a carrying and storage pouch for the receptacle. Various closure means operable after the pouch has been formed are provided, plus a carrying strap stowed between the patch and the wall when the receptacle is in use. In a preferred embodiment, the receptacle is made from two panels joined at their lower edges, the panels being configured to approximate the shape of a tennis or similar racquet. A closure such as a zipper is used to join the panels around their perimeter to retain such a racquet.

DETAILED DESCRIPTION OF THE PREFERRED EMBODIMENTS

Figure 1:
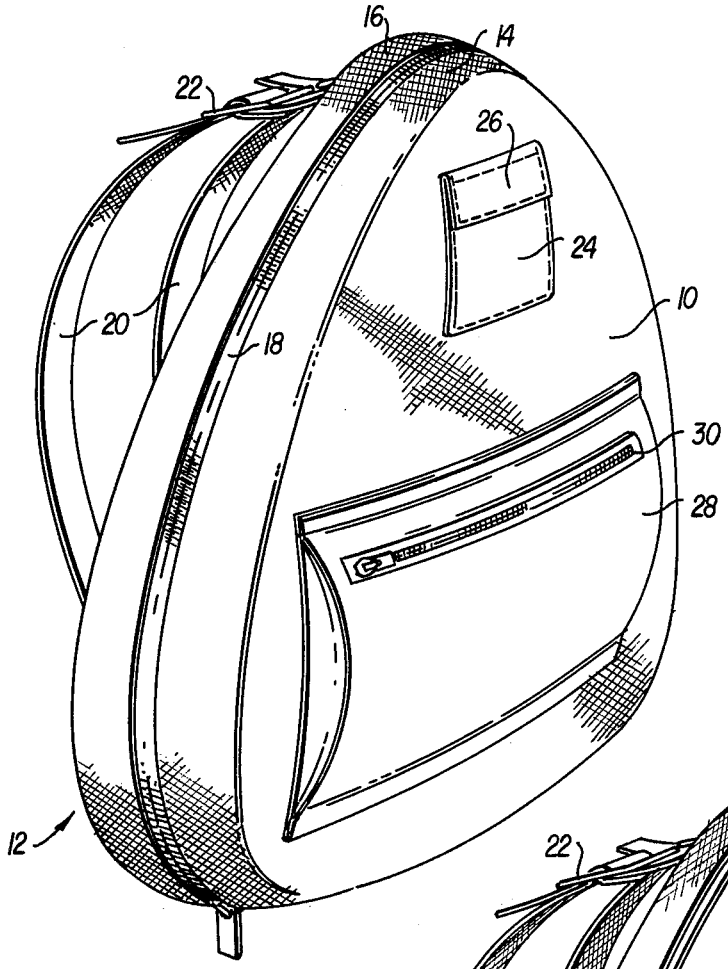
FIG. 1 shows a perspective view of a knapsack embodying the invention, indicating particularly the shape of the device to conform to a racquet head.

There follows a detailed description of the preferred embodiments of my invention, reference being had to the drawings in which like reference numerals identify like elements of structure in each of the several Figures.

Figure 2:
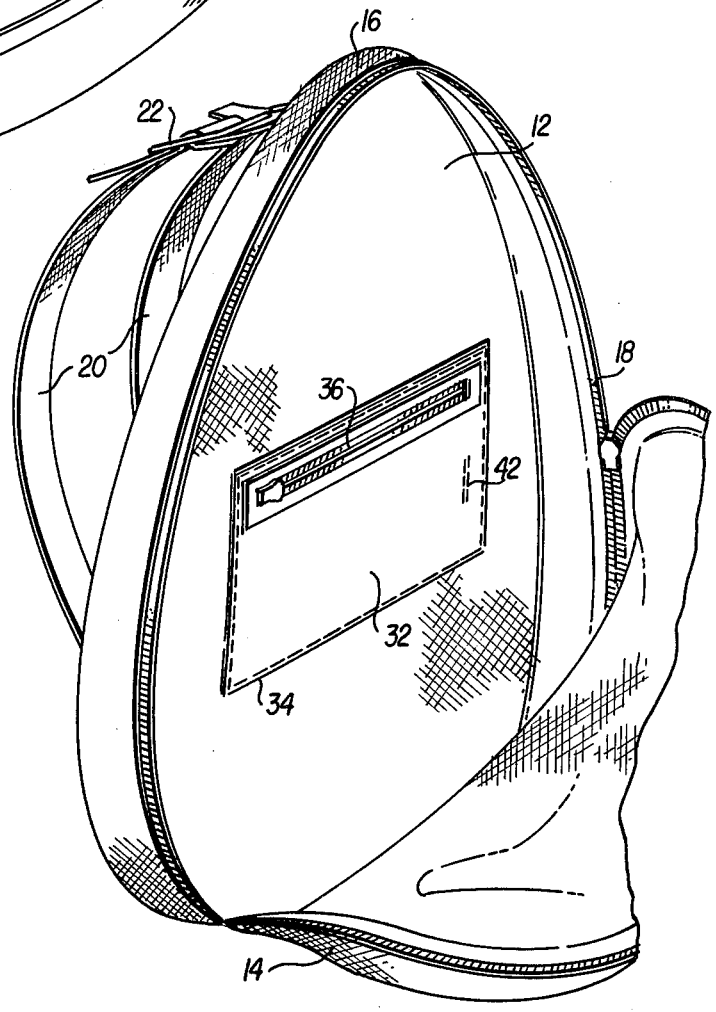
FIG. 2 shows a perspective view of the device of FIG. 1 in its open configuration, indicating the preferred location of the storage pouch of the invention.

Referring to FIGS. 1 and 2, the knapsack according to my invention comprises a front panel or wall 10 and a back panel or wall 12, of similar configurations generally simulating the contour of the head or strung portion of a tennis racquet. Of course, other shapes may be used without departing from the scope of my invention. The material preference for the invention is thin, flexible cloth of nylon or the like which is lightweight and collapses easily into a small volume. Side panels 14 and 16 are joined to panels 10 and 12, respectively, by means such as stitching. Although not illustrated, side panels 14 and 16 are joined to each other at their bottom edges, thereby securing front and back panels 10 and 12 to each other. A long zipper 18 is attached between side panels 14 and 16 to permit easy opening and closing of the receptacle, as illustrated in FIG. 2. Carrying straps 20, with adjustment buckles 22, are attached to back panels 12 in the usual fashion. A small storage pocket 24 having a VELCRO closure flap 26 is provided on front panel 10, just above a larger pocket 28 having a zipper closure 30. Pocket 28 preferably is sized to receive two or three tennis balls. When the invention is used to carry a tennis racquet, the head of the racquet is placed between front and back panels 10 and 12, with the handle extending from the device at the lower left corner, as viewed in FIG 2. Zipper 18 is then closed to seam the racquet.

Figure 3:
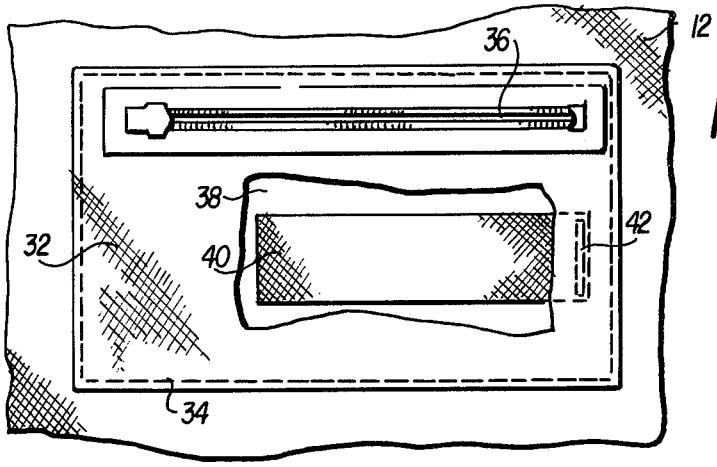
FIG. 3 shows a partially broken away view of the storage pouch according to the invention, indicating the location of the carrying strap within the pouch.

FIGS. 2 and 3 illustrate the unique storage pocket or pouch of my invention. A patch 32 of the same material as panels 10 and 12 preferably is attached to the interior surface of back panel 12 by stitching about its perimeter 34. An opening, closable by means such as a zipper 36, is provided through patch 32 to give access to the volume between patch 32 and the portion 38 of back panel 12 which is covered by patch 32. Of course, patch 32 could also be attached to front panel 10 and to the exterior of the device, if desired, without departing from the spirit of my invention. A carrying strap 40 is attached to patch 32 by means such as stitching 42, so that strap 40 is located between patch 32 and panel 12 when the invention is in use in the configurations shown in FIGS. 1 to 3.

Figure 4:
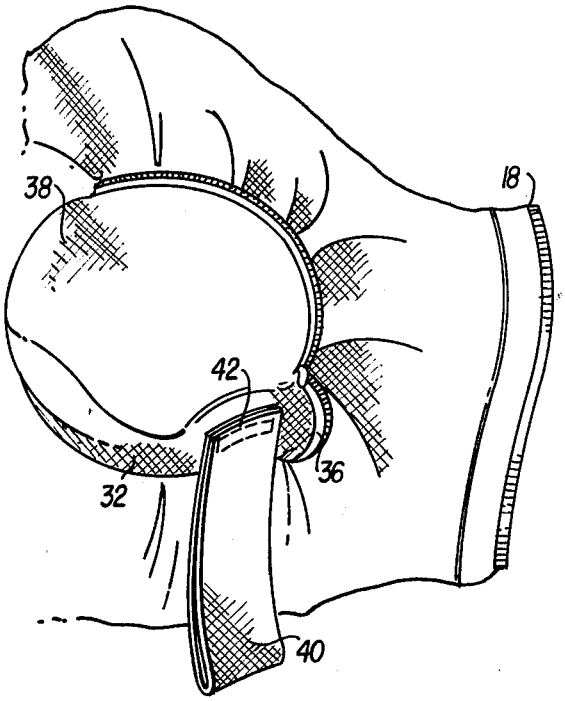
FIG. 4 illustrates how the device is stuffed into its carrying and storage pouch.

FIG. 4 shows how my invention is used to stuff the receptacle into the storage pouch formed between patch 32 and portion 38. The user first pushes portion 38 out through the opening in zipper 36 so that portion 38 and patch 32 form a pouch. Strap 40 comes through the opening as patch 32 is reversed in forming the pouch, thereby forming a convenient handle for hand carrying or a hanger for carrying the device on a bicycle handle bar, for example. When the receptacle has been stuffed into its pouch, zipper 36 is accessible for closing the pouch to the configuration shown in FIG. 5A. A compact, easily carried or stowed configuration is thus achieved.

Figure 5B:
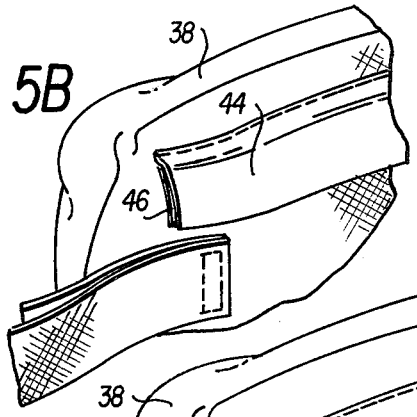
FIGS. 5B and 5C show fragmentary views of alternate forms of pouch closures.
Figure 5C:
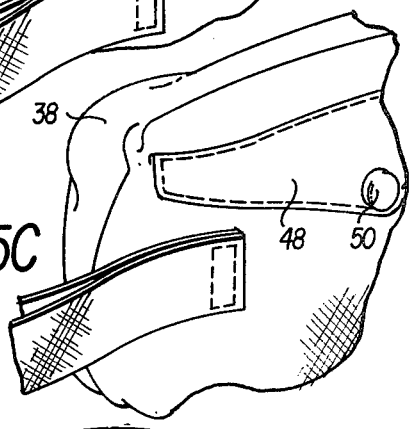
Figure 5A:
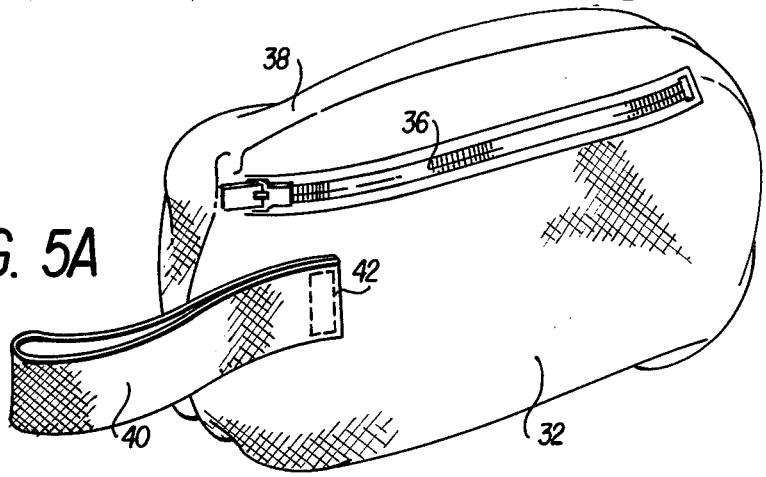
FIG. 5A shows a perspective view of the invention after it has been stuffed into its pouch and the pouch closure has been closed.

FIGS. 5B and 5C show alternate types of closures useful in my invention. A flap 44 having a VELCRO portion 46 may be used. Or, a flap 48 having a snap or button 50 is also suitable. Other forms of closures operable when the receptacle has been stuffed into its pouch may be used without departing from the scope of my invention.

Having described by invention in sufficient detail to enable one skilled in the art to make and use it, I claim:

1. In a portable receptacle made of thin, flexible material, said receptacle being a knapsack having a wall, and means permitting said knapsack to be carried on the back of the user, the improvement comprising:

a patch of said material attached to said wall around the perimeter of said patch;

an opening through said patch within said perimeter to provide access to the volume between said patch and said wall whereby the portion of said wall covered by said patch may be pushed out through said opening whereby said patch is reversed in order that the side of said patch which is next to said portion prior to pushing said portion through said opening forms a portion of the exterior surface of a pouch and when said pouch is formed the receptacle may be stuffed into the pouch for ease of storage and transportation and first closure means operable for shutting said opening after said receptacle has been stuffed into said pouch.

2. The portable receptacle of claim 1, wherein said patch is attached to an interior surface of said wall.

3. The portable receptacle of claim 1, further comprising a carrying strap attached to said patch between said patch and said wall, whereby said strap is accessible for carrying said pouch after said receptacle has been stuffed into said pouch.

4. The portable receptacle of claim 2, further comprising a carrying strap attached to said patch between said patch and said wall, whereby said strap is accessible for carrying said pouch after said receptacle has been stuffed into said pouch.

5. The portable receptacle of claim 1, wherein said first closure means is a zipper operable when said receptacle has been stuffed into said pouch.

6. The portable receptacle of claim 1, wherein said first closure means is a VELCRO-type fastener operable when said receptacle has been stuffed into said pouch.

7. The portable receptacle of claim 1, wherein said first closure means is a snap operable when said receptacle has been stuffed into said pouch.

8. The portable receptacle of claim 5, wherein said patch is attached to an interior surface of said wall.

9. The portable receptacle of claim 6, wherein said patch is attached to an interior surface of said wall.

10. The portable receptacle of claim 7, wherein said patch is attached to an interior surface of said wall.

11. The portable receptacle of claim 1, wherein said receptacle comprises first and second panels shaped generally to conform to the head of a tennis or similar racquet, said panels being joined to each other at the lower ends thereof; and second closure means attached to the perimeters of said panels for closing said receptacle to retain a racquet therein.

12. The portable receptacle of claim 1 wherein said first closure means is a button operable when said receptacle has been stuffed into said pouch.

13. The portable receptacle of claim 12 wherein said patch is attached to an interior surface of said wall.

* * * * *